United States Patent [19]

Taylor

[11] Patent Number: 4,698,963

[45] Date of Patent: Oct. 13, 1987

[54] LOW $NO_x$ COMBUSTOR

[75] Inventor: Jack R. Taylor, Cincinnati, Ohio

[73] Assignee: The United States of America as represented by the Department of Energy, Washington, D.C.

[21] Appl. No.: 516,190

[22] Filed: Jul. 22, 1983

Related U.S. Application Data

[63] Continuation of Ser. No. 256,343, Apr. 22, 1981, abandoned.

[51] Int. Cl.[4] ..... F02C 7/26

[52] U.S. Cl. ..... 60/39.06; 60/732; 60/737; 60/747

[58] Field of Search ..... 60/732, 747, 733, 39.06, 60/737, 738

[56] References Cited

U.S. PATENT DOCUMENTS 3,973,395 8/1976 Markowski et al. ..... 60/39.65
4,041,699 8/1977 Schelp ..... 60/732
4,173,118 11/1979 Kawaguchi ..... 60/39.65
4,292,801 10/1981 Wilkes et al. ..... 60/39.06

OTHER PUBLICATIONS

Carlstrom et al—"Improved Emissions Performance in Today's Combustion System"—6/14/78—p. 17.

*Primary Examiner*—Carlton R. Croyle
*Assistant Examiner*—Donald E. Stout
*Attorney, Agent, or Firm*—Judson R. Hightower; Richard E. Constant

[57] ABSTRACT

A combustor having an annular first stage, a generally cylindrically-shaped second stage, and an annular conduit communicably connecting the first and second stages. The conduit has a relatively small annular height and a large number of quench holes in the walls thereof such that quench air injected into the conduit through the quench holes will mix rapidly with, or quench, the combustion gases flowing through the conduit. The rapid quenching reduces the amount of $NO_x$ produced in the combustor.

4 Claims, 4 Drawing Figures

LOW $NO_x$ COMBUSTOR

The invention disclosed herein was made in the course of, or under, a contract with the United States Department of Energy.

This is a continuation of application Ser. No. 256,343, filed Apr. 22, 1981, and now abandoned.

BACKGROUND OF THE INVENTION

1. Field of the Invention

This invention relates to gas turbine combustors and particularly to a new and improved combustor in which nitric oxide ($NO_x$) emissions are reduced.

2. Description of the Prior Art

Undesirable pollutants, such as nitric oxide ($NO_x$), are often produced during operation of a gas turbine engine. $NO_x$ is produced within the combustor of the engine as a result of burning of the fuel-air mixture therein. It is environmentally desirable, and, under certain governmental regulations, it is required, to reduce the amount of $NO_x$ produced to low levels.

Some combustor configurations have been found to reduce $NO_x$ emissions to acceptable levels, yet are also complex and expensive to build. For example, combustors employing water injection are effective for reducing $NO_x$ emissions, but they require holding tanks, water pumps and water supply manifolds. Two stage, lean burning combustors are also effective for reducing $NO_x$ emissions, but such combustors are also complex and expensive.

Another combustor configuration which can reduce $NO_x$ emissions is the "rich-lean" two stage combustor. The typical rich-lean combustor comprises two burning zones, a rich zone and a lean zone, separated by a quench zone. In the quench zone, air is mixed with the rich combustor gases in order to lean the gases as they enter the lean zone. By "rich" is meant that the gases have a fuel-air equivalence ratio greater than 1; by "lean" is meant that the gases have a fuel-air equivalence ratio less than 1. The rate of $NO_x$ production during burning of the combustor gases in both the rich zone and the lean zone is relatively low. However, the rate of $NO_x$ production in the quench zone, wherein the combustor gases undergo a transition from a rich to a lean condition, is relatively high. Since the $NO_x$ formation rate is time dependent, the less time that the combustor gases within a rich-lean combustor spend in the transition condition in the quench zone, the lower will be the amount of $NO_x$ produced.

Current rich-lean combustors, however, employ quenching arrangements which tend to prolong the amount of time it takes to quench the combustor gases from a rich condition to a lean condition. For example, the jet penetration distance, or distance that the quench air must travel from the quench holes in the walls of the quench zone to the center of the quench zone, is relatively large in many current combustors. The quench air must thus travel a relatively large distance to thoroughly mix with the combustor gases and, in so doing, the amount of time required to reduce the fuel-air equivalence ratio to a lean condition is extended.

Correspondingly, in order to provide jets of quench air with enough energy to travel the greater jet penetration distance, the combustor must employ large diameter, rather than small diameter, quench holes. Due to space and structural limitations, the number of quench holes which can be employed is reduced when the holes have a large diameter rather than a small diameter. The smaller number of large diameter holes are less effective for rapidly mixing the quench air with the combustor gases than would be a greater number of small diameter holes, and thus the amount of time required to reduce the fuel-air equivalence ratio of the combustor gases to a lean condition is extended.

Therefore, the greater jet penetration distance and smaller number of large diameter quench holes result in a greater amount of $NO_x$ being produced during combustion.

Some rich-lean combustor arrangements employ annular quench zones. Such an arrangement permits quench air to enter the quench zone through quench holes in both the radially inner and radially outer walls of the annulus. However, the annular height of the quench zone remains relatively large, requiring large diameter quench holes for thorough mixing. As a result, $NO_x$ production remains relatively high.

In view of the above-mentioned problems, it is therefore an object of the present invention to reduce the amount of $NO_x$ production within a rich-lean combustor by reducing the annular height of the quench zone within the combustor and thereby reducing the time required for quenching.

Another object of the present invention is to reduce the amount of $NO_x$ produced in a rich-lean combustor by increasing the number of quench holes in the quench zone of the combustor, thereby also reducing the quenching time.

SUMMARY OF THE INVENTION

The present invention comprises a combustor for a gas turbine engine. The combustor is arranged concentrically about an axis and comprises an annular first stage, a generally cylindrically-shaped second stage disposed downstream of the first stage, and an annular conduit disposed between the first and second stages which provides fluid communication between the two stages. The conduit includes a plurality of quench holes through at least one wall thereof for reducing the fuel-air equivalence ratio of the combustion gases as they flow through the conduit. The conduit is disposed such that the radial distance from the axis to the radially inner wall of the conduit is greater than the radial distance from the axis to the radial inner wall of the first stage. This arrangement promotes rapid reduction in the fuel-air equivalence ratio of the combustion gases and is thereby effective for reducing the amount of nitric oxide ($NO_x$) produced during combustion.

In a particular embodiment of the invention, the radially inner walls of the first stage and the conduit are defined by a substantially hollow centerbody. Quench air can thus be injected into the conduit through the radially inner wall as well as through the radially outer wall of the conduit.

BRIEF DESCRIPTION OF THE DRAWING

This invention will be better understood from the following description taken in conjunction with the accompanying drawing, wherein.

DESCRIPTION OF THE PREFERRED EMBODIMENT

Figure 1:
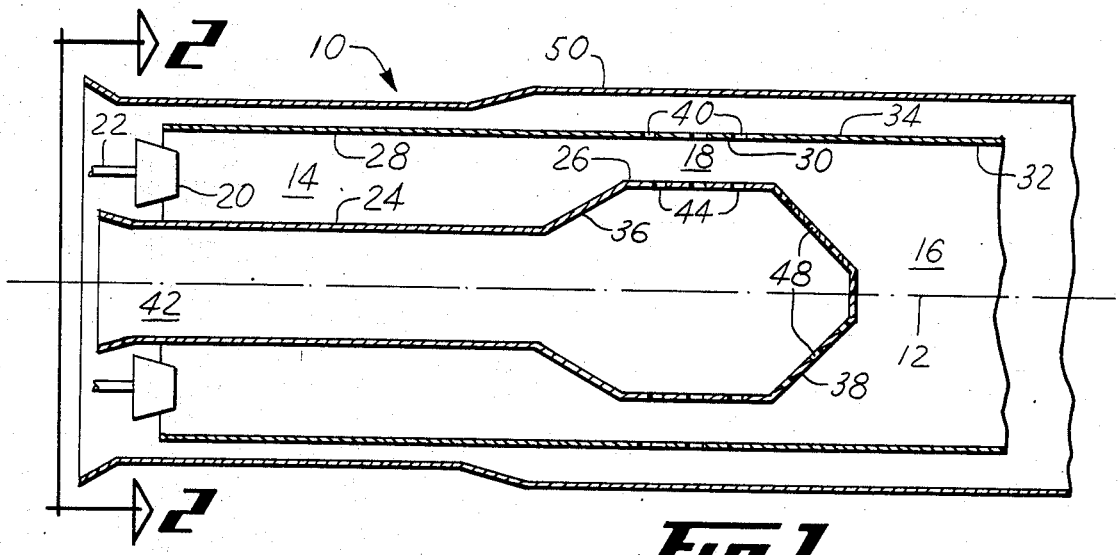
FIG. 1 is a cross-sectional view of one embodiment of a combustor incorporating features of the present invention.

Turning now to a consideration of the drawing, and in particular to FIG. 1, there is shown one embodiment of a combustor 10 for a gas turbine engine. The combustor 10 is arranged substantially concentrically about a longitudinal axis, designated by the dashed line 12. The combustor 10 comprises an annular first stage 14, a generally cylindrically-shaped second stage 16 disposed downstream of the first stage 14, and an annular conduit 18 disposed between the first and second stages 14 and 16. The conduit 18, which comprises the quench zone of the combustor, provides fluid communication between the first and second stages 14 and 16 and is arranged such that all of the hot gases exiting the first stage must pass through the conduit in order to enter the second stage.

Fuel and air are mixed and burned within the combustor 10 and work is extracted from the resultant hot gases. For example, the hot gases can be directed to flow across blades of a turbine (not shown) to rotate the turbine.

Figure 2:
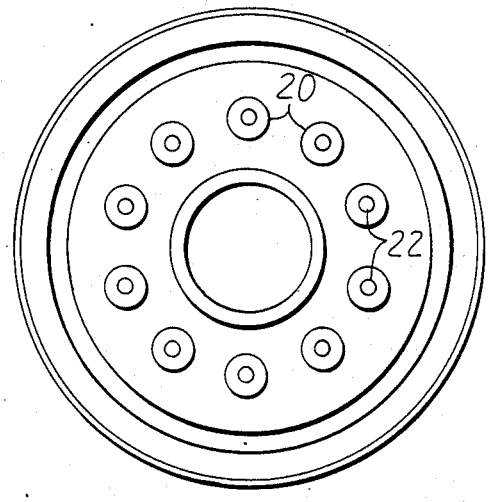
FIG. 2 is a view of the upstream end of the combustor taken along lines 2—2 of FIG. 1.

Fuel and air for combustion are introduced into the combustor 10 through the upstream end thereof. One example of a means for injecting the fuel and air can be seen in FIGS. 1 and 2. A plurality of swirl cups 20 are disposed around the upstream end of the combustor 10. Fuel injector tubes 22 supply fuel through the swirl cups 20. High pressure air from the compressor (not shown) flows into the swirl cups 20 wherein it is mixed with fuel. The fuel-air mixture then enters the combustor 10 wherein it is burned. Of course, many other arrangements for introducing fuel and air into the combustor can be successfully employed with the combustor of this invention and the arrangement shown in FIGS. 1 and 2 is for example only.

As can be seen in FIG. 1, the first stage 14 and the conduit 18 each includes radially inner walls 24 and 26 and radially outer walls 28 and 30, respectively. The second stage 16 includes a radial wall 32. Preferably, the radially outer walls 28 and 30 of the first stage 14 and the conduit 18 and the radial wall 32 of the second stage 16 are defined by a generally cylindrically-shaped liner 34 which extends substantially the length of the combustor 10. The radially inner walls 24 and 26 of the first stage 14 and the conduit 18 are preferably defined by a centerbody 36 which is disposed concentrically about the axis 12. The centerbody 36 can have any desired shape. One example of the shape is shown in FIG. 1 wherein, from its upstream end, the centerbody 36 extends generally axially, parallel to the axis 12, then diverges toward the liner 34 and thereby with the liner defines the first stage 14. The centerbody then extends axially to define, with the liner 34, the conduit 18. The centerbody then diverges toward the axis 12 to define an upstream wall 38 of the second stage 16.

For reasons to be explained hereinafter, the conduit 18 is disposed such that the radial distance from the axis 12 to the radially inner portion, that is, the radially inner wall 26, of the conduit 18 is greater than the radial distance from the axis 12 to the radially inner portion, that is, the radially inner wall 24, of the first stage 14. Also, it is preferable that the annular height of the conduit 18, that is, the radial distance between the radially inner wall 26 and the radially outer wall 30, is less than the annular height of the first stage 14, that is the radial distance between the radially inner wall 24 and the radially outer wall 28. Furthermore, in the configuration as shown in FIG. 1, the radial distance from the axis 12 to the radially outer wall 30 of the conduit 18 is not less than the radial distance from the axis to the radially outer wall 28 of the first stage 14.

For reasons also to be explained hereinafter, the conduit 18 includes a plurality of quench holes through at least one wall thereof. As can be seen in FIG. 1, there are a plurality of quench holes 40 through the radially outer wall 30 of the conduit 18. Preferably, the centerbody 36 is substantially hollow and has an open upstream end 42 such that the centerbody can receive a flow of air from its upstream end. The protion of the centerbody 36 defining the radially inner wall 26 of the conduit 18 includes a plurality of quench holes 44 therethrough. Additionally, the downstream portion of the centerbody 36 which defines the upstream wall 38 of the second stage 16, preferably includes at least one dilution hole 48 therethrough.

There is also included around the outside of the liner 34 an air passage, such as is defined between the generally annular liner 34 and the casing 50, for providing a supply of air to the quench holes 40 in the radially outer wall 30 of the conduit 18.

The above-described combustor arrangement is commonly referred to as a "rich-lean" combustor. Fuel is introduced into the first stage 14 through the fuel injection tubes 22 and mixed with a relatively small amount of air from the swirl cups 20. The fuel-air equivalence ratio, that is, the ratio of fuel to air divided by the stoichiometric ratio of fuel to air, is greater than 1, thus the first stage 14 is often referred to as the rich stage. The partially burned gases flow downstream through the conduit 18 where more air, called quench air, is mixed with the gases. Combustion is completed in the second stage into which additional dilution air can be introduced. The fuel-air equivalence ratio in the second stage is less than 1, and thus the second stage 16 is often referred to as the lean stage.

Figure 3:
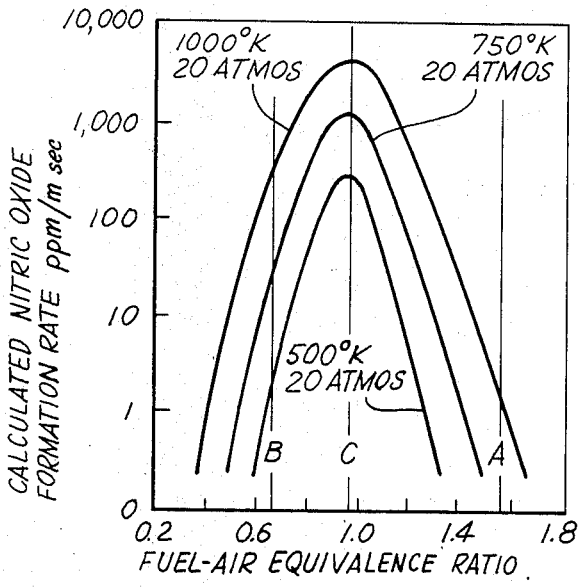
FIG. 3 shows a graph of the calculated nitric oxide formation rate at various fuel-air equivalence ratios.

Referring to FIG. 3, there is shown a graph of the calculated nitric oxide ($NO_x$) formation rate versus the fuel-air equivalence ratio for various initial mixing conditions. As can be seen from the graph, the $NO_x$ formation rate is low for high and low fuel-air equivalence ratios. For example, point A represents the approximate fuel-air equivalence ratio in the first stage 14. Point B represents the approximate fuel-air equivalence ratio in the second stage 16. As can be seen, the $NO_x$ formation rate in both the first and second stages 14 and 16 is relatively low.

However, the graph of FIG. 3 also shows that at intermediate fuel-air equivalence ratios, the $NO_x$ formation rate is high. For example, point C on the graph represents the approximate fuel-air equivalence ratio of the combustion gases while they are in the conduit 18, which comprises the quench zone of the combustor, during the transition from high to low fuel-air equivalence ratios. As can be seen, the $NO_x$ formation rate in the conduit 18 is high.

The combustor 10 of the present invention is arranged to rapidly quench, or inject additional air into, the combustor gases as they pass through the conduit 18, thereby rapidly reducing the fuel-air equivalence ratio. The more rapidly the fuel-air equivalence ratio of the combustor can be decreased from point A to point B on the graph of FIG. 3, the less time the fuel-air equivalence ratio will be in the vicinity of point C and the lower will be the amount of $NO_x$ formed.

Returning to FIG. 1, air for quenching is injected into the conduit 18 through the quench holes 40 in the radially outer wall 30 of the conduit and also preferably through the quench holes 44 in the radially inner wall 26 of the conduit.

The particular dimensions of the first and second stages 14 and 16 of the combustor 10 require that the conduit 18 be of a corresponding particular cross-sectional flow area in order to optimize combustor efficiency. The combustor of the present invention includes a "necked down" conduit 18 which has a reduced cross-sectional flow area compared to that of the first stage 14. That particular cross-sectional flow area of the conduit 18 can be maintained and yet the annular height of the conduit can be decreased by increasing the radial distance of the radially inner wall 26 of the conduit from the axis 12. That is, the larger the diameter of the annular conduit 18, the smaller need be the annular height of the conduit to maintain a constant cross-sectional flow area.

As described earlier, the combustor 10 of the present invention includes a conduit 18 having a relatively large diameter and therefore a relatively small annular height. The advantage of a small annular height is that the quench air which is injected through the quench holes 40 and 44 into the conduit 18 has a shorter distance to travel, or penetration distance, in order to thoroughly mix with the combustion gases and therefore the quench air mixes more rapidly. Furthermore, with a shorter penetration distance requirement, the quench holes 40 and 44 can be of a smaller diameter. Consequently, for a conduit 18 of any given dimensions, a greater number of smaller quench holes than larger quench holes can be spaced around the radially inner and outer walls 26 and 30 of the conduit. The greater number of small holes promotes more rapid mixing of the quench air with the combustion gases. Finally, since the conduit 18 is necked down, the velocity of the combustion gases increases as the gases flow from the first stage 14 through the conduit. This velocity increase tends to effect a more rapid mixing of the quench air with the combustion gases.

Rapid mixing of the quench air with the combustion gases effects a rapid transition of the combustion gases from a high fuel-air equivalence ratio, or rich mixture, to a low fuel-air equivalence ratio, or lean mixture. Returning to FIG. 3, a more rapid transition from point A to point B means that the combustion gases spend less time in the vicinity of point C on the graph and consequently a lower amount of $NO_x$ is produced.

Figure 4:
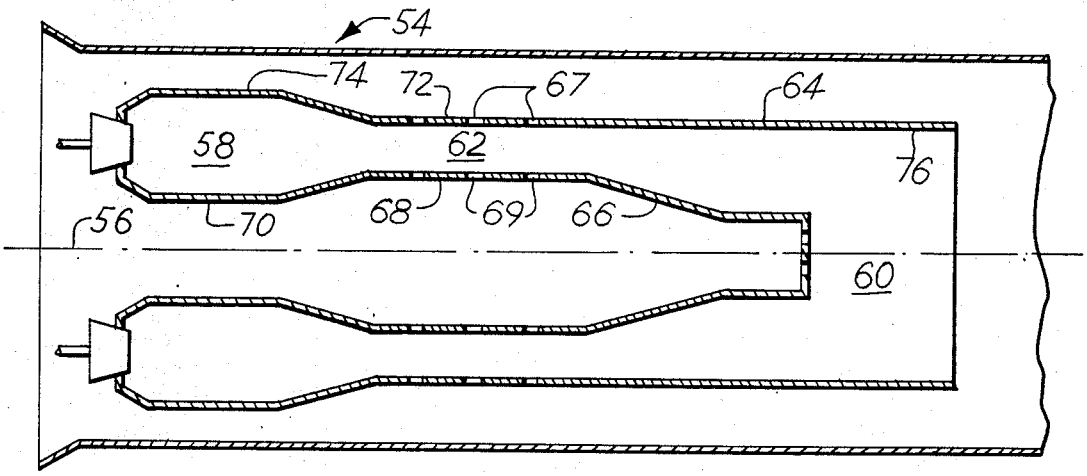
FIG. 4 is a cross-sectional view of another embodiment of a combustor incorporating features of the present invention.

Referring to FIG. 4, there is shown another embodiment of the invention. This embodiment of the combustor 54 is also a rich-lean combustor and is similar to the combustor 10 shown in FIG. 1 except for the shapes of the outer liner and the centerbody. The combustor 54 is arranged substantially concentrically about a longitudinal axis 56 and includes an annular first stage 58, a generally cylindrically-shaped second stage 60, and an annular conduit 62, which comprises the quench zone and which provides fluid communication between the first and second stages. The combustor 54 includes a liner 64 and a centerbody 66, which define the first and second stages 58 and 60 and the conduit 62, the liner and centerbody including quench holes 67 and 69, respectively, therethrough.

The annular height of the conduit 62 is less than the annular height of the first stage 58 and the radial distance from the axis 56 to the radially inner wall 68 of the conduit 62 is greater than the radial distance from the axis 56 to the radially inner wall 70 of the first stage 56.

However, in this configuration, the liner 64 is shaped such that the radial distance from the axis 56 to the radially outer wall 72 of the conduit 62 is less than the radial distance from the axis to the radially outer wall 74 of the first stage 58. This arrangement results from the outer liner 64 being shaped such that the portion of the liner defining the first stage 58 is enlarged radially outwardly from the portion defining the conduit 62 and the second stage 60. Likewise, the portion of the centerbody 66 defining the first stage 58 can be shaped to be enlarged radially inwardly. This radially enlarged first stage 58 permits the first stage to be shorter axially than is the first stage 14 of the configuration shown in FIG. 1. The overall length of the combustor 54 is therefore correspondingly shorter than the overall length of the combustor 10 shown in FIG. 1. Thus, the configuration of FIG. 4 may be desirable where a shorter combustor is required.

The portion of the centerbody 66 downstream of the conduit 62 is shaped to promote efficient gas flow of the combustion gases into the second stage 60. For example, as can be seen in FIG. 4, the centerbody can be elongated axially, converging toward the axis 56 with a relatively gentle slope. However, it is to be understood that the shape of the centerbody can be modified as desired to make it most suitable for the operating conditions to be encountered within the combustor.

The combustor 54 operates and is effective for reducing $NO_x$ emissions in the same manner as is the combustor 10 of the first embodiment, and therefore that part of the description will not be repeated.

Characterized another way, the present invention provides an annular first stage 14 which defines a flowpath and which receives fuel and air at an upstream region. The annular first stage 14 supports combustion of this fuel-air mixture and the mixture is rich, not lean, having an equivalency ratio greater than unity. An annular conduit 18 located downstream of the first stage 14 receives the burning fuel-air mixture and quenches the mixture in a manner such that the equivalency ratio is reduced below unity (i.e., the mixture is rendered lean) before the mixture exits the annular conduit.

Applicant achieves this reduction by accelerating the mixture in the annular conduit, thus utilizing this conduit as n accelerator. The acceleration occurs because of the reduced annular height of the annular conduit 18, which reduces the cross-sectional area of the conduit as compared with that of the first stage. The acceleration causes the mixture to dwell within the annular conduit for a shorter time, because the mixture is now traveling faster.

While the mixture is within the annular conduit, a plurality of jets of air admitted by a plurality of holes 44 are injected into the mixture. In one embodiment, circular holes of about $\frac{1}{4}$ inch in diameter and spaced about $\frac{3}{4}$ inch apart, center-to-center, were used. It was found that, while the increased speed of the fuel-air mixture reduces the dwell time of the mixture in the annular conduit, and thus reduces the opportunity (in terms of time of availability) of the mixture for quenching, impressive NOx reductions were obtained.

One important aspect of the present invention lies in the fact that substantially all fuel to be burned is injected at one upstream location, namely, in the region of the fuel nozzles 22. That is, the present invention is not a combustor utilizing pilot combustion, followed by additional fuel injection for main combustion.

Another important aspect of the present invention lies in the fact that substantially all air which supports combustion is supplied either at the region of the fuel nozzles 22 or by the quench holes 44 in the annular conduit 18, and at no other location.

Another important aspect lies in the substantial completion of quenching within the annular conduit 18.

It is to be understood that this invention is not limited to the particular embodiments disclosed and it is intended to cover all modifications coming within the true spirit and scope thereof.

What is claimed is:

1. A gas turbine engine combustor, consisting essentially of:

(a) a hollow centerbody having a cylindrical upstream portion of a relatively small diameter and a cylindrical downstream portion of a relatively large diameter, the centerbody being substantially imperforate with the exception of a plurality of holes located in the downstream portion for directing quenching air in radially outward directions, the quenching air being supplied through the hollow upstream portion of the centerbody;

(b) a cylindrical outer wall surrounding the centerbody and extending downstream of the downstream portion of the centerbody, the cylindrical outer wall defining (i) an annular first chamber between the cylindrical outer wall and the upstream portion of the centerbody for receiving a swirling fuel-air mixture which is ignited within the first chamber without the occurrence of pilot combustion, (ii) a second chamber downstream of the centerbody, and (iii) an, generally smooth-walled, annular passage between the outer wall and the downstream portion of the centerbody, the annular passage functioning to receive the burning fuel-air mixture from the first stage and to conduct the burning fuel mixture from the first chamber to the second chamber, the cylindrical outer wall being substantially imperforate with the exception of a plurality of holes located axially adjacent the holes of (a) for directing quenching air into the annular passage of (b)(iii) in radially inward directions.

2. In a gas turbine engine, a method of burning fuel in a combustor having a single fuel injection stage and having upstream and downstream portions, comprising the steps of:

(a) generating, in an upstream annular first stage of the combustor, a burning fuel-air mixture which has a fuel-air equivalence ratio greater than unity and which is flowing downstream;

(b) channeling the burning fuel-air mixture into an annular conduit located downstream of the first stage, the annular conduit (i) being defined by radially inner and radially outer walls and (ii) having an annular height less than the annular height of the annular first stage;

(c) injecting substantially all quench air to be added to the fuel into the annular conduit through a plurality of holes contained in the radially inner and outer walls of (b)(i)

(i) for reducing the fuel-air equivalence ratio below unity, (ii) for causing the greatest rate of NOx production to occur within the annular conduit; and (d) venting the burning fuel-air mixture mixed with quench air from the annular conduit of (c) to a second stage for further combustion.

3. In an annular gas turbine engine combustor which provides an annular fuel-air mixture, the improvement comprising (a) an annular conduit for receiving and accelerating the fuel-air mixture and for reducing the annular height of the mixture, and (b) means for injecting a plurality of oppositely moving airstreams into the accelerated mixture while the mixture is present within the annular conduit, whereby the fuel-air equivalence ratio of the mixture is reduced below unity while within the annular conduit and wherein the oppositely moving airstreams contain substantially all of the combustion air added to the fuel-air mixture.

4. An annular combustor for a gas turbine engine, comprising (a) means for defining an annular flowpath;

(b) means for injecting substantially all fuel to be burned within the combustor at an upstream region of the flowpath;

(c) means for injecting airstreams into the fuel for generating a downstream-moving air fuel mixture within the flowpath;

(d) accelerating means located at a downstream region of the flowpath for (i) receiving substantially all of the moving air-fuel mixture;

(ii) accelerating the received air fuel mixture;

(iii) reducing the cross-sectional area of the fuel-air mixture by reducing the annular height of the fuel-air mixture;

(iv) injecting a plurality of airstreams into the accelerated fuel-air mixture for reducing the fuel-air ratio below unity while contained within the acceleration means and then, following (d)(iv), (v) venting the fuel-air mixture into a second chamber for further combustion.

* * * * *